US005437169A

United States Patent [19]

Mitchell et al.

[11] Patent Number: 5,437,169

[45] Date of Patent: Aug. 1, 1995

[54] STARCH COOKING/DISPENSING APPARATUS

[76] Inventors: Wesley W. Mitchell, 2701 Brushy Creek Trail, Mesquite, Tex. 75181; Wilson W. Mitchell, 3801 Hickox Rd., Rowlett, Tex. 75088

[21] Appl. No.: 192,559

[22] Filed: Feb. 7, 1994

[51] Int. Cl.[6] ..... D06F 39/02

[52] U.S. Cl. ..... 68/17 R; 68/207; 127/28

[58] Field of Search ..... 134/93; 68/17 R, 207; 137/268; 127/28

[56] References Cited

U.S. PATENT DOCUMENTS

| | | | |
|---|---|---|---|
| 476,320 | 6/1892 | Shepherd | 127/28 |
| 1,191,324 | 7/1916 | Lenders | 127/28 X |
| 1,411,934 | 4/1922 | Rankin | 127/28 |
| 1,418,320 | 6/1922 | Miller | 127/28 |
| 2,015,566 | 9/1935 | Lowry | 134/93 |
| 2,204,615 | 6/1940 | Nivling | 127/28 |
| 2,730,468 | 1/1956 | Martin | 127/28 |
| 2,940,876 | 6/1960 | Elsas | 127/28 |
| 3,423,238 | 1/1969 | Weiland | 127/28 |
| 3,622,388 | 11/1971 | Larson | 127/28 |
| 4,964,185 | 10/1990 | Lehn | 134/93 Y |

*Primary Examiner*—Frankie L. Stinson
*Attorney, Agent, or Firm*—Carla J. Dolce

[57] ABSTRACT

A starch cooking/dispensing apparatus cooks and dispenses a starch solution to a commercial laundry machine by substantially filling a reservoir with water, agitating the water in the reservoir, adding dry starch to the water to form a starch suspension, heating the starch suspension to form a starch solution and then dispensing the starch solution to a commercial laundry machine.

20 Claims, 2 Drawing Sheets

STARCH COOKING/DISPENSING APPARATUS

BACKGROUND OF THE INVENTION

1. Field of the Invention

The present invention relates to a starch cooking/dispensing apparatus for preparing individual batches of cooked starch and dispensing each batch individually to a commercial laundry machine as needed.

2. Description of Related Art

In most modern commercial laundries, starch is added to the commercial laundry machines either by adding a precooked dry starch or a liquid synthetic starch directly to the machines as needed. Both precooked and synthetic starch are significantly more expensive than uncooked starch, which is sometimes referred to as "pearl starch". Additionally, precooked starch frequently does not dissolve completely leaving starch specks on the garments as well as causing starch build-up on the press heads when the garments are pressed. To avoid the expense of precooked starch some commercial laundries add uncooked starch directly to the laundry machines. The uncooked starch is later cooked when the garment is pressed. Although this method reduces starch costs, it causes starch buildup on the press heads and results in uneven starching of the garments.

To reduce the costs of using precooked dry starch or synthetic starch and to avoid the problems with using uncooked starch, some larger commercial laundries use existing starch cookers in which a large vat of starch solution is cooked and then drawn from the vat manually. Some examples of existing starch cookers can be seen in U.S. Pat. No. 2,253,262 to Bierly, U.S. Pat No. 1,418,320 to Miller, or U.S. Pat. No. 1,190,690 to Tyler.

Some existing starch cookers use steam both to cook the starch and to agitate the starch solution. Agitation of the starch during cooking is necessary to prevent the formation of lumps. Agitation with steam, however, generally is not sufficient to prevent the formation of lumps. Thus, the existing cookers that use steam both to agitate and to cook the starch often create a starch having lumps that cause uneven starching of the garments and starch build up on the press heads when the garments are pressed. Furthermore, if the steam is left on continuously, the starch may overcook resulting in inferior starching of the garments. If the steam is turned off, the starch settles leaving an unevenly mixed solution.

Some existing starch cookers use a continuously-heated jacket around the starch cooking vat to cook the starch. The jacket, generally heated by steam coils, remains hot at all times often causing over-cooking of the starch and lumps.

Another problem with existing starch cookers is the large size of the vats and the consequently large quantities of starch that are cooked. If the entire batch of starch is not used on the same day it is cooked, it may spoil and impart a foul odor to the garments if it is used. Thus, it is sometimes necessary to discard unused starch mixed by the larger vat starch cookers. Moreover, the large size also causes problems with cleaning. Any neglect in the cleaning of the starch vat may result in spoilage of residual starch left in the vat. The spoiled residual starch may impart an odor to the next batch of starch making the next batch unsuitable for use.

With some existing starch cookers, the hot starch is drawn off manually and carried to the commercial laundry machine. The manual transfer of the hot starch presents the danger of employees being burned.

SUMMARY OF THE INVENTION

It is a first object of the present invention to provide a starch cooking/dispensing apparatus for use in commercial laundries that cooks single batches of starch so that all of the starch in each batch is discharged to a single laundry machine for a single batch of garments.

It is a second object of the present invention to provide a starch cooking/dispensing apparatus that has a means for agitating the starch solution that minimizes or eliminates the formation of lumps.

It is a third object of the present invention to provide a starch cooking/dispensing apparatus that is self-cleaning.

It is a fourth object of the present invention to provide a starch cooking/dispensing apparatus that is economical because it allows commercial laundries to use uncooked ("pearl") starch and eliminates or nearly eliminates any waste of starch.

The foregoing objects and other objectives, features and advantages of the invention will be more readily understood from the following brief summary of the invention and the detailed description of preferred embodiments set forth below.

The present invention relates to a commercial starch cooking/dispensing apparatus comprising a reservoir having capacity for holding a single batch of starch solution; means for substantially filling the reservoir with water; means for agitating the water in the reservoir; means for dispensing dry starch into the water in the reservoir to form a starch suspension; means for heating the starch suspension to dissolve the starch to create a starch solution; and means for dispensing the starch solution from the reservoir into the commercial laundry machine. The apparatus may be cleaned after each batch of starch is dispensed by permitting clean water to wash through the reservoir and other parts of the apparatus as the starch solution is being dispensed.

DESCRIPTION OF THE PREFERRED EMBODIMENTS

The preferred embodiments of the invention are described with reference to the FIGS. 1, 2, 3, 4, and 5 wherein like numbers represent like parts.

Figure 1:
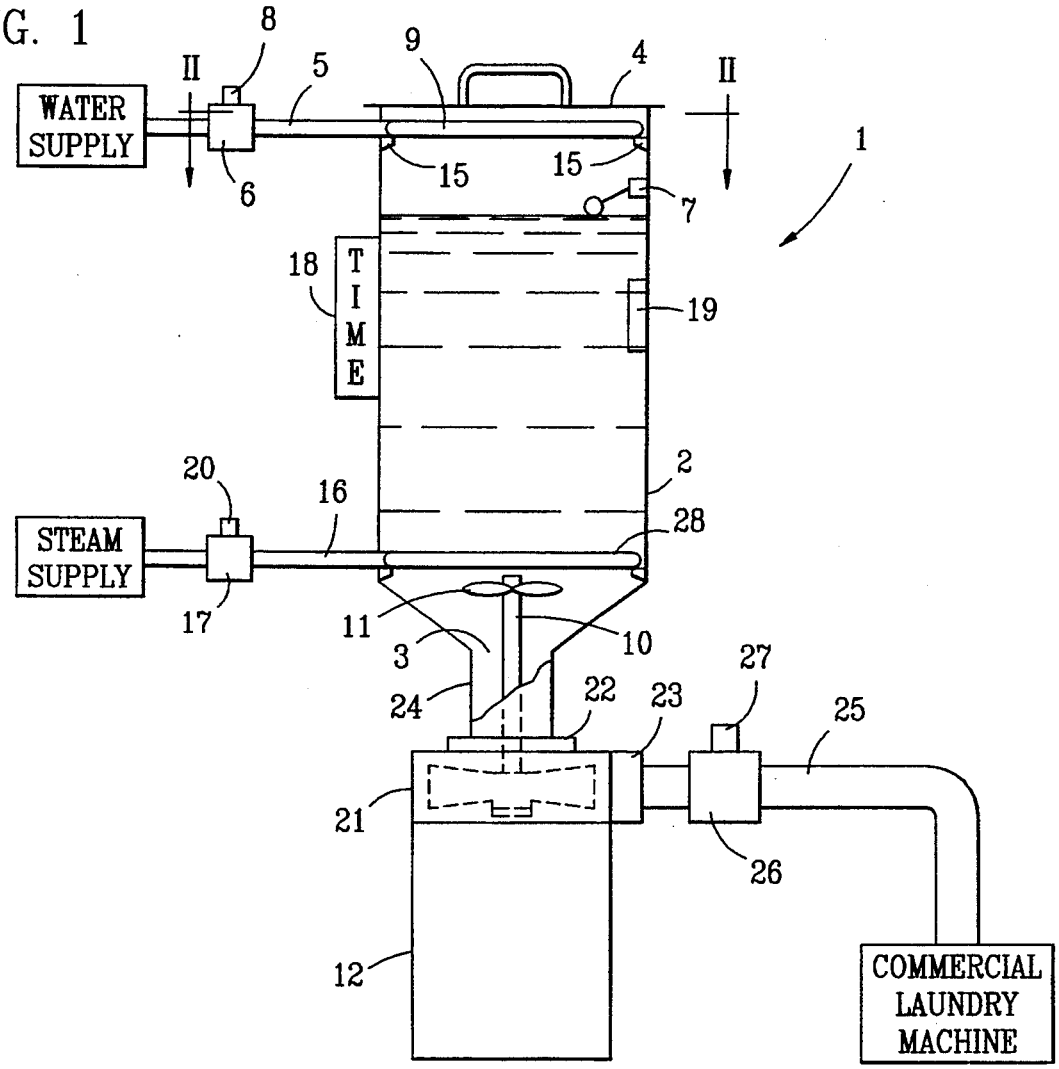
FIG. 1 is a vertical sectional view of one embodiment of the apparatus
Figure 4:
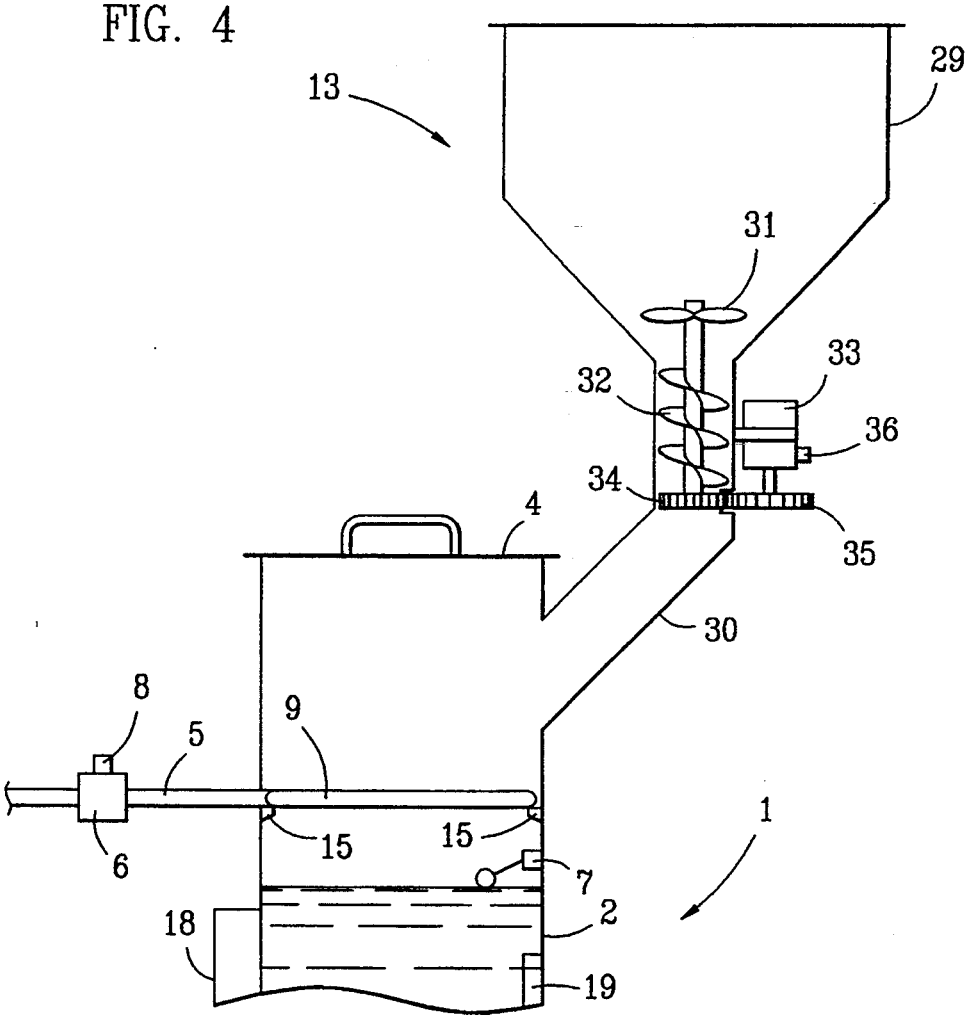
FIG. 4 is a partial vertical sectional view of an alternative embodiment of the apparatus having an automatic powdered product dispenser.
Figure 5:
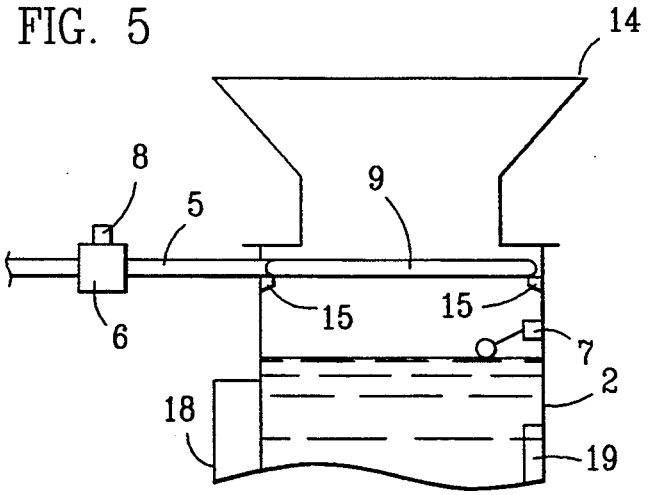
FIG. 5 is a partial vertical sectional view of an alternative embodiment of the apparatus having a chute for adding dry starch.

As depicted in FIG. 1, starch cooking/dispensing apparatus 1 comprises reservoir 2, which may be of any suitable shape having capacity for holding a single batch of starch solution. Reservoir 2 is shown in FIG. 1 as a cylindrical sheet metal tank having a bottom that is cone shaped with walls that converge toward reservoir discharge opening 3. Reservoir 2 may be open at the top; it may have loose-fitting, removable lid 4 as depicted in FIGS. 1 and 4; or it may have inlet chute 14 as depicted in FIG. 5. Alternatively, reservoir 2 may have automatic powdered product dispenser 13 associated with it as depicted in FIG. 4. If reservoir 2 has loose-fitting lid 4, lid 4 has one or more holes that serve as vent holes to vent excess steam. In all embodiments of the invention, a vent for excess steam is provided.

Means is provided for substantially filling reservoir 2 with water. The means for substantially filling reservoir 2 with water includes a source of water such as a municipal water supply line. As depicted in FIG. 1, the water source is connected to reservoir 2 by water supply conduit 5. Connected to water supply conduit 5 between the water source and reservoir 2 is water supply valve 6 which selectively opens to permit water to enter reservoir 2 or selectively closes to prevent the flow of water into reservoir 2.

The means for substantially filling reservoir 2 with water further comprises means for opening water supply valve 6 when reservoir 2 is substantially empty and for closing water supply valve 6 when reservoir 2 is substantially full. Preferably, as depicted in FIG. 1, the means for selectively opening and closing water supply valve 6 comprises float device 7 and water supply solenoid 8. Float device 7 is associated with reservoir 2 for determining when reservoir 2 is substantially empty and when it is substantially full. Water supply solenoid 8 is an electrically energized solenoid responsive to float device 7 and connected to water supply valve 6. Water supply solenoid 8 opens water supply valve 6 when float device 7 determines that reservoir 2 is substantially empty and closes water supply valve 6 when float device 7 determines that reservoir 2 is substantially full.

Figure 2:
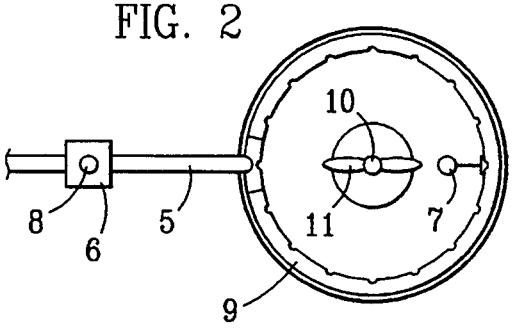
FIG. 2 is a horizontal sectional view of the embodiment of the apparatus depicted in FIG. 1 on the line II—II.
Figure 3:
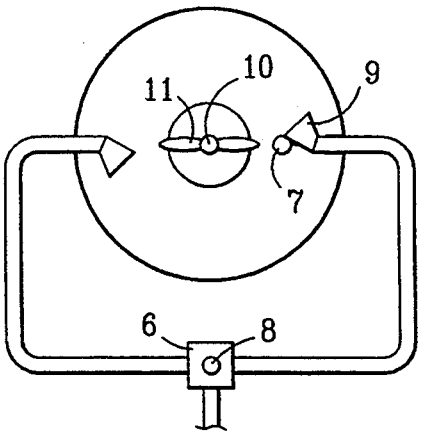
FIG. 3 is a horizontal sectional view of an alternative embodiment of the apparatus in FIG. 1 on the line II—II, in which the sprayer is comprised of two sprayer heads.

As depicted in the drawings, the means for substantially filling reservoir 2 with water may further comprise sprayer 9 inside reservoir 2 and in fluid flow communication with water supply conduit 5. Sprayer 9 sprays water so as to wash the interior walls of reservoir 2 when water enters. As depicted in FIGS. 1 and 2, sprayer 9 may be a circular conduit having a plurality of pores along its perimeter through which water flows causing a spray of water. Sprayer 9 as depicted in FIGS. 1 and 2 may be supported by sprayer supports 15 attached to reservoir 2. Alternatively, as depicted in FIG. 3, sprayer 9 may be two sprayer heads each at opposite sides of reservoir 2 and positioned so that the water spraying from the heads contacts a maximum area of the interior walls of reservoir 2.

Starch cooking/dispensing apparatus 1 further comprises means for agitating the water to minimize the formation of lumps. The means for agitating the water in reservoir 2 may comprise a cyclically movable stirring device projecting into reservoir 2 and means for cyclically moving the stirring device to agitate the water. As depicted in the drawings, the cyclically movable stirring device comprises rotatable shaft 10 extending through reservoir discharge opening 3 and propeller 11 attached to shaft 10 for agitating the water when rotated by shaft 10. As depicted in FIG. 1, the means for cyclically moving the stirring device may comprise electric motor 12 for rotating shaft 10 and propeller 11. Electric motor 12 may be controlled by timing device 18 which is in electrical communication with the commercial laundry machine into which the starch solution will ultimately be dispensed. After timing device 18 receives a signal from the commercial laundry machine, it relays that signal to electric motor 12 causing electric motor 12 to start.

Timing device 18 preferably comprises a microprocessor and a plurality of relays. The microprocessor measures time, receives and processes signals from the commercial laundry machine, and communicates with the plurality of relays for controlling one or more functions of starch cooking/dispensing apparatus 1. Such microprocessor timing devices are well known and readily available from companies such as Knight Equipment Corporation, 2945 Airway Ave., Costa Mesa, Calif., Nova Controls, 2121 Delaware Ave., Santa Cruz, Calif., Electronic Power Designs, 662 Myrtle Ave., Boonton, N.J., and others. The microprocessor board KIO 3000PCB from Knight Equipment Corporation, for example, may be used in timing device 18.

Alternatively, electric motor 12 may be controlled by a signal from a device, such as an electrically energized solenoid, responsive to float device 7 so that motor 12 starts running when float device 7 signals that reservoir 2 is substantially full and stops running when float device 7 signals that reservoir 2 is substantially empty. Electric motor 12 may also be controlled manually by a switch. The operator may start electric motor 12 when a visual inspection indicates that reservoir 2 is substantially full and stop electric motor 12 when a visual inspection indicates that reservoir 2 is substantially empty.

Starch cooking/dispensing apparatus 1 further provides a means for dispensing dry starch into the water in reservoir 2 to form a starch suspension. To prevent the formation of lumps, starch is preferably added to the water in reservoir 2 either simultaneously or shortly after the means for agitating the water has been activated so that the water is being agitated as the dry starch is added. The dry starch that is used is an uncooked ("pearl") starch.

The means for dispensing dry starch into the water in reservoir 2 may be the manual addition of a premeasured quantity of dry starch directly into the water in reservoir 2. Alternatively, means for dispensing dry starch into reservoir 2 comprises the manual addition of dry starch into inlet chute 14 attached to the reservoir as shown in FIG. 5. The chute may further comprise a door (not shown in the drawings) hingedly connected to inlet chute 14 for temporarily closing inlet chute 14 when dry starch is not being dispensed.

Preferably, as depicted in FIG. 4 the means for dispensing dry starch into the water in reservoir 2 comprises powdered product dispenser 13 associated with the reservoir for automatically dispensing dry starch into the reservoir when a batch of starch solution is required. Such automatic powdered product dispensers are readily available commercially. Powdered product dispenser 13 may be controlled by timing device 18. When timing device 18 receives a signal from the commercial laundry machine, it relays that signal to powdered product dispenser 13 causing starch to be dispensed into the water in reservoir 2.

An example of an automatic powdered product dispenser is depicted in FIG. 4. As depicted in FIG. 4, powdered product dispenser 13 may comprise dry starch reservoir 29 which is connected to reservoir 2 by dry starch inlet chute 30. Dry starch is dispensed by the rotating motion of screw-action dispenser 32 which is rotated by dry starch motor 33 through the use of gears 34 and 35. Dry starch propeller 31 is connected to and rotates with screw-action dispenser 32 for mixing the dry starch as it is dispensed to minimize caking. Preferably, powdered product dispenser 13 further comprises dry starch solenoid 36 which is an electrically energized solenoid responsive to timing device 18 and connected to dry starch motor 33. Dry starch solenoid 36 starts dry starch motor 33 when it receives a signal from timing device 18 in response to the signal received by timing device 18 from the commercial laundry machine. Timing device 18 measures the time required for the desired amount of dry starch to be dispensed into reservoir 2 and, at the end of the required time, signals dry starch solenoid 36 which then stops dry starch motor 33.

Starch cooking/dispensing apparatus 1 further comprises means for heating the starch suspension to dissolve the starch to create a starch solution. This process of dissolving the starch is referred to in the laundry trade as "cooking" the starch. This process of cooking the starch changes the milky, partially opaque starch suspension into a clear or nearly clear starch solution. As depicted in FIG. 1, the means for heating the starch suspension comprises a source of steam, steam inlet conduit 16 connecting reservoir 2 with the steam source, and steam inlet valve 17 connected to steam inlet conduit 16 for selectively opening to permit steam to flow into the starch suspension or closing to prevent the flow of steam into the starch suspension.

Preferably, the means for heating the starch suspension further comprise timing device 18, thermostat 19, and steam inlet solenoid 20. Timing device 18 is associated with starch cooking/dispensing apparatus 1 for measuring the length of time the dry starch has been mixed with the water to form a starch suspension. After the water has begun agitating in reservoir 2 and the dry starch added, the starch should be agitated with the water for about 5–15 seconds before steam inlet valve 17 opens to permit the flow of steam into the suspension. Thermostat 19 is associated with starch cooking/-dispensing apparatus 1 for determining when the heated starch solution has reached a predetermined temperature which should be approximately 180° to 195° F. for cooking the starch and changing the starch suspension to a starch solution. Steam inlet solenoid 20 is an electrically energized solenoid connected to steam inlet valve 17 and responsive to timing device 18 and thermostat 19 for opening steam inlet valve 17 when timing device 18 signals the end of a predetermined starch suspension mix time period, and for closing steam inlet valve 17 when thermostat 19 determines that the heated starch solution has reached the predetermined temperature of approximately 180° to 195° F.

Preferably, steam inlet conduit 16 is connected to steam diffusion head 28 on the inside of reservoir 2 so that all the steam entering the starch suspension/solution is diffused first through steam diffusion head 28. Steam diffusion head 28 may be a circular conduit like sprayer 9, as shown in FIGS. 1 and 2, having a plurality of pores through which the steam passes.

Starch cooking/dispensing apparatus 1 further comprises means for dispensing the cooked starch solution from reservoir 2 to the commercial laundry machine. The means for dispensing the cooked starch solution may comprise pumping means that may include electrically-driven, centrifugal pump 21 having pump inlet 22 and pump out let 23. Pump inlet 22 is connected to reservoir discharge opening 3 by pump inlet conduit 24. Pump outlet 23 is connected to the commercial laundry machine by discharge conduit 25. Discharge valve 26 is connected to discharge conduit 25 selectively opening to permit the starch solution to flow from the pump to the commercial laundry machine or closing to prevent the starch solution from flowing from the pump to the commercial laundry machine. As shown in FIG. 1, pump 21 may be driven by the same electric motor 12 that moves rotatable shaft 10 and propeller 11. In that case, rotatable shaft 10 is connected, for example by welding, to the top of the impellers for pump 21 which is a centrifugal pump.

Discharge valve 26 may be operated manually. The operator may open discharge valve 26 when the operator determines that the temperature of the starch solution has reached the desired temperature between 180° and 195° F. or when starch is required by the commercial laundry machine and close discharge valve 26 after the starch solution has discharged. Preferably, discharge valve 26 remains open for a premeasured time after the discharge of the starch solution so that water from water supply conduit 5 continues to enter through sprayer 9 to clean reservoir 2 while the starch solution is being discharged and for a short time after the solution has been discharged so that sufficient clean water passes through discharge conduit 25 to clean all parts of starch cooking/dispensing apparatus 1 between water supply conduit 5 and the commercial laundry machine.

Preferably, the means for dispensing the cooked starch solution from reservoir 2 into the commercial laundry machine further comprises timing device 18, thermostat 19 and means for opening discharge valve 26 when the starch solution has reached a certain temperature, preferably between 180° to 195° F., and for closing discharge valve 26 after discharge valve 26 has been open for a predetermined period of time. The predetermined period of time is calculated based on the length of time required for the starch solution in reservoir 2 to discharge through discharge valve 26 plus an additional period of time for permitting clean water to flow through starch cooking/dispensing apparatus 1 to clean it. The means for opening and closing discharge valve 26 may include pump discharge solenoid 27. Pump discharge solenoid 27 is an electrically energized solenoid connected to discharge valve 26 and responsive to thermostat 19 for opening discharge valve 26 when the temperature of the starch solution reaches a predetermined temperature and responsive to timing device 18 for closing discharge valve 26 when timing device 18 signals that the discharge valve has been open for a predetermined period of time.

Alternatively, the means for dispensing the cooked starch solution from reservoir 2 into the commercial laundry machine further comprises only timing device 18 and means for opening discharge valve 26 when the commercial laundry machine has signaled for the discharge of the starch solution and for closing discharge valve 26 after discharge valve 26 has been open for a predetermined period of time sufficient to discharge the starch solution and to rinse clean the apparatus. The means for opening and closing discharge valve 26 may include pump discharge solenoid 27. Pump discharge solenoid 27 is an electrically energized solenoid connected to discharge valve 26 and responsive to timing device 18 for opening discharge valve 26 after timing device 18 has received a signal from the commercial laundry machine calling for the starch discharge and responsive to timing device 18 for closing discharge valve 26 when the timing device signals that the discharge valve has been open for a predetermined period of time sufficient to permit the starch solution to be discharged and further permit the apparatus to be rinsed by clean water. In this alternative, timing device 18 includes a microprocessor and a plurality of relays. The microprocessor measures time, receives and processes signals from the commercial laundry machine, and communicates with the plurality of relays for controlling one or more functions of starch cooking/dispensing apparatus 1.

Starch cooking/dispensing apparatus 1 may have an insulating jacket (not shown in the drawings) wrapped around reservoir 2 to prevent heat loss and to muffle the sounds that may be made by the operation of the apparatus.

Although the present invention has been shown and described with respect to preferred embodiments, various changes and modifications which are obvious to a person skilled in the art to which the invention pertains are deemed to lie within the spirit and scope of the invention.

What is claimed is:

1. An apparatus for cooking consecutive single batches of a predetermined quantity of liquid starch solution and dispensing each entire single batch of solution into a commercial laundry machine, comprising:

a. a reservoir having capacity for holding a single batch of starch solution, the reservoir having sidewalls, a bottom, and a drain in communication with the laundry machine;

b. means for substantially filling the reservoir with water;

c. agitation means for agitating the water in the reservoir;

d. means for dispensing dry starch into the water in the reservoir to form a starch suspension;

e. means for heating the starch suspension to dissolve the starch to create a starch solution;

f. discharge means for and dispensing the entire batch of starch solution from the reservoir through the drain into the commerical laundry machine; and g. spraying means inside the reservoir and in fluid flow communication with the conduit connecting the reservoir with the source of water for spraying water onto the sidewalls while the discharge means is operating, for washing the sidewalls of starch solution while the batch of starch solution is being dispensed into the laundry machine, the water being sprayed onto the sidewalls also passing through the drain to the laundry machine.

2. The apparatus of claim 1, wherein the spraying means comprises:

a spryer conduit extending around an inside perimeter of the reservoir adjacent an upper end of the reservoir.

3. The apparatus of claim 1, wherein the means for agitating the water in the reservoir comprises:

a. a cyclically movable stirring device having a shaft projecting through the drain into the reservoir for agitating the water when rapidly moved therein;

b. means for cyclically moving the stirring device for agitating the water.

4. The apparatus of claim 1, wherein the means for dispensing dry starch into the water in the reservoir comprises a powdered product dispenser associated with the reservoir for automatically dispensing dry starch into the reservoir when a batch of starch solution is required.

5. The apparatus of claim 1, wherein the means for dispensing dry starch into the water in the reservoir comprises an inlet chute attached to the reservoir for manually dispensing dry starch therethrough.

6. The apparatus of claim 1, wherein the means for dispensing the dry starch into the water in the reservoir comprises the manual addition directly into the reservoir of a premeasured quantity of dry starch.

7. The apparatus of claim 1, wherein the means for heating the starch suspension to cook the starch comprises:

a. a source of steam;

b. a conduit connecting the reservoir with the steam source;

c. a steam inlet valve connected to the conduit for selectively opening to permit steam to flow into the starch suspension or closing to prevent the flow of steam into the starch suspension.

8. The apparatus of claim 7 further including:

a. a timing device associated with the starch cooking apparatus for measuring the length of time the dry starch has been agitated with the water to form a starch solution;

b. a thermostat associated with the starch cooking apparatus for determining when the heated starch solution has reached a predetermined temperature; and c. an electrically energized solenoid connected to the steam inlet valve and responsive to the timing device and the thermostat for opening the steam inlet valve when the timing device signals the end of a predetermined starch solution mix time period, and for closing the steam inlet valve when the thermostat determines that the heated starch solution has reached the predetermined temperature.

9. The apparatus of claim 7 further comprising a steam diffusion head inside the reservoir and in fluid flow communication with the conduit connecting the reservoir with the source of steam.

10. The apparatus of claim 1, wherein the discharge means comprises:

a. a pump having a pump inlet and a pump discharge;

b. a pump inlet conduit connecting the pump inlet to the drain of the reservoir;

c. a discharge conduit connecting the pump discharge to the laundry machine;

d. a discharge valve connected to the discharge conduit selectively opening to permit the starch solution to flow from the pump to the laundry machine and selectively closing to prevent the flow of starch solution from the pump to the laundry machine.

11. The apparatus of claim 10 further comprising:

a. a thermostat associated with the starch cooking/-dispensing apparatus for determining when the heated starch solution has reached a predetermined temperature;

b. a timing device associated with the starch cooking/dispensing apparatus for measuring the length of time the discharge valve has been open; and c. an electrically energized solenoid connected to the discharge valve and responsive to the thermostat and the timing device for opening the discharge valve when the thermostat signals that the heated starch solution has reached a predetermined temperature and closing the discharge valve when the timing device signals that the discharge valve has been open for a predetermined period of time.

12. The apparatus of claim 11 wherein the predetermined period of time is calculated to permit the discharge of the starch solution and the discharge of additional clean water to the spraying means to clean the reservoir, the pump inlet conduit, the discharge valve and the discharge conduit.

13. The apparatus of claim 10 further comprising:

a. timing device including a plurality of relays associated with the apparatus for measuring the length of time the discharge valve has been open and for receiving and relaying a signal from the commercial laundry machine;

b. an electrically energized solenoid connected to the discharge valve and responsive to the timing device for opening the discharge valve when the timing device receives and relays the signal from the commercial laundry machine and closing the discharge valve when the timing device signals that the discharge valve has been open for a predetermined period of time.

14. The apparatus of claim 13 wherein the predetermined period of time is calculated to permit the discharge of the starch solution and the discharge of additional clean water to the spraying means to clean the reservoir, the pump inlet conduit, the discharge valve and the discharge conduit.

15. The apparatus of claim 1, wherein the spraying means comprises:

at least two sprayer nozzles positioned inside the reservoir and oriented for spraying tangentially along the sidewall of the reservoir adjacent an upper end of the reservoir for creating a swirling action.

16. The apparatus of claim 1, wherein the agitation means comprises:

a. a cyclically movable stirring device having a rotatable shaft extending through the drain into the reservoir and a blade attached to the shaft above the drain for agitating the water in the reservoir when rotated by the shaft; and b. an electrical motor coupled to the shaft for rotating the shaft; and wherein the discharge means comprises:

c. a discharge pump mounted to the drain, the discharge pump having an impeller mounted to the shaft of the stirring device for rotation therewith by the motor; and d. discharge valve means downstream of the discharge pump for opening the drain to cause the discharge pump to discharge the entire batch of starch solution to the laundry machine.

17. An apparatus for cooking a single batch of a predetermined quantity of liquid starch solution and dispensing the entire single batch of solution to a commercial laundry machine comprising:

a. a reservoir having capacity for holding a single batch of starch solution, the reservoir having sidewalls, a bottom, and a drain in the bottom in communication with the laundry machine;

b. means for substantially filling the reservoir with water;

c. a cyclically movable stirring device having a rotatable shaft extending upward through the drain into the reservoir and a blade attached to the shaft above the drain for agitating the water in the reservoir when rotated by the shaft;

d. means for dispensing dry starch into the water in the reservoir to form a starch suspension;

e. means for heating the starch suspension to dissolve the starch to create a starch solution;

f. a discharge pump mounted to the drain, the discharge pump having an impeller mounted to the shaft of the stirring device for rotation therewith;

g. a motor connected to the shaft of the stirring device for rotating the shaft and the impeller of the pump simultaneously; and h. discharge valve means downstream of the discharge pump for opening the drain to cause the discharge pump to discharge the entire batch of starch solution to the laundry machine.

18. An apparatus for cooking a single batch of a predetermined quantity of liquid starch solution and dispensing the entire single batch of solution to a commercial laundry machine comprising:

a. a reservoir having capacity for holding a single batch of starch solution, the reservoir having sidewalls and a bottom containing a drain in communication with the laundry machine;

b. means for substantially filling the reservoir with water;

c. a cyclically movable stirring device having a rotatable shaft extending upward through the drain into the reservoir and a blade attached to the shaft above the drain for agitating the water in the reservoir when rotated by the shaft;

d. means for dispensing dry starch into the water in the reservoir to form a starch suspension;

e. means for heating the starch suspension to dissolve the starch to create a starch solution;

f. a discharge pump mounted to the drain, the discharge pump having an impeller mounted to the shaft of the stirring device for rotation therewith;

g. a motor connected to the shaft of the stirring device for rotating the shaft and the impeller of the pump simultaneously; and h. discharge valve means downstream of the discharge pump for opening the drain to cause the discharge pump to discharge the entire batch of starch solution to the laundry machine; and i. spraying means inside the reservoir and in fluid flow communication with the conduit connecting the reservoir with the source of water for spraying water onto the sidewalls while the discharge valve means is open, for washing the sidewalls of starch solution as the batch of starch solution is being discharged into the laundry machine, the water being sprayed onto the sidewalls also passing through the drain to the laundry machine.

19. The apparatus of claim 18, wherein the spraying means comprises:

a spryer conduit extending around an inside perimeter of the reservoir adjacent an upper end of the reservoir.

20. The apparatus of claim 18, wherein the spraying means comprises:

at least two sprayer nozzles positioned inside the reservoir and oriented for spraying tangentially along the sidewall of the reservoir adjacent an upper end of the reservoir for creating a swirling action.

* * * * *